US011652275B2

(12) United States Patent
Oh

(10) Patent No.: US 11,652,275 B2
(45) Date of Patent: May 16, 2023

(54) DISPLAY APPARATUS

(71) Applicant: SAMSUNG ELECTRONICS CO., LTD., Suwon-si (KR)

(72) Inventor: Sanggi Oh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

(21) Appl. No.: 17/112,416

(22) Filed: Dec. 4, 2020

(65) Prior Publication Data

US 2021/0194112 A1 Jun. 24, 2021

(30) Foreign Application Priority Data

Dec. 20, 2019 (KR) ..... 10-2019-0172421

(51) Int. Cl.
*H01Q 1/22* (2006.01)
*H01Q 5/307* (2015.01)
*H01Q 9/04* (2006.01)

(52) U.S. Cl.
CPC ..... *H01Q 1/2291* (2013.01); *H01Q 5/307* (2015.01); *H01Q 9/0407* (2013.01)

(58) Field of Classification Search
CPC .... H01Q 1/2291; H01Q 5/307; H01Q 9/0407; H01Q 5/40; H01Q 9/40; H01Q 19/108; H01Q 5/30; G02F 1/133308; G02F 1/133314; G02F 1/133325; H04N 5/64
See application file for complete search history.

(56) References Cited

U.S. PATENT DOCUMENTS

2010/0295736 A1* 11/2010 Su ..... H01Q 21/28 343/700 MS
2011/0032170 A1 2/2011 Chiang et al.
2012/0009884 A1* 1/2012 Rao ..... H01Q 13/10 455/115.2
2014/0242903 A1* 8/2014 DeLuis ..... H01Q 1/521 343/893
2020/0335850 A1* 10/2020 Oh ..... H01Q 1/2258

FOREIGN PATENT DOCUMENTS

| | | |
|---|---|---|
| JP | 2013-021474 | 1/2013 |
| KR | 10-2005-0091310 | 9/2005 |
| KR | 10-2011-0041785 | 4/2011 |
| KR | 10-2013-0004430 | 1/2013 |
| KR | 10-2017-0052014 | 5/2017 |
| WO | 2012/153282 | 11/2012 |

OTHER PUBLICATIONS

International Search Report dated Apr. 15, 2021 in corresponding International Application No. PCT/KR2020/018663.

* cited by examiner

*Primary Examiner* — Hai V Tran
*Assistant Examiner* — Michael M Bouizza
(74) *Attorney, Agent, or Firm* — Nixon & Vanderhye P.C.

(57) ABSTRACT

Disclosed is a display apparatus including: a display panel, a chassis supporting the display panel, a cover coupled to the chassis, a substrate disposed between the chassis and the cover, and a multi-band antenna disposed on the substrate. The multi-band antenna includes a first radiator configured to transmit and receive radio signals in a first frequency band and disposed on the substrate and extending parallel to the substrate, and a second radiator configured to transmit and receive radio signals in a second frequency band different from the first frequency band and protruding toward the cover at a position adjacent to the first radiator.

20 Claims, 8 Drawing Sheets

------ : RADIATION PERFORMANCE WHEN ONLY FIRST RADIATOR IS PROVIDED

——— : RADIATION PERFORMANCE WHEN FIRST RADIATOR AND SECOND RADIATOR ARE PROVIDED

DISPLAY APPARATUS

CROSS-REFERENCE TO RELATED APPLICATION

This application is based on and claims priority under 35 U.S.C. § 119 to Korean Patent Application No. 10-2019-0172421, filed on Dec. 20, 2019, in the Korean Intellectual Property Office, the disclosure of which is incorporated by reference herein in its entirety.

BACKGROUND

1. Field

The disclosure relates to a display apparatus including a multi-band antenna, and for example, to a display apparatus including a multi-band antenna with improved radiation performance.

2. Description of Related Art

A display apparatus may refer, for example, to a type of output apparatus that visually displays data information such as characters and graphics and images, and includes televisions, various monitors, and various portable terminals (e.g., notebook computers, tablet PCs, and smart phones).

A display apparatus may support wireless communication functions such as Wi-Fi. Recently, an antenna having a very wide frequency band covering a plurality of service bands or a multi-band antenna operating in dual or multiple frequency bands is sometimes provided in the display apparatus.

In a display apparatus such as a television (TV), because an antenna is located at the rear of a display panel and a chassis, it is difficult for radio waves radiated from the antenna to be transmitted to the front of the display apparatus. In particular, when the antenna is disposed inside from an edge of the display panel, a high-band frequency such as Wi-Fi 5 GHz is mainly radiated only to the rear of the display apparatus, making it difficult to secure performance.

SUMMARY

Embodiments of the disclosure provide a display apparatus including a multi-band antenna capable of responding to a plurality of frequency bands and having improved radiation performance.

Embodiments of the disclosure provide a display apparatus capable of securing radiation performance to the front even when a multi-band antenna is located inside from an edge of the display apparatus.

Additional aspects of the disclosure will be set forth in part in the description which follows and, in part, will be apparent to one skilled in the art.

In accordance with an example embodiment of the disclosure, a display apparatus includes: a display panel, a chassis supporting the display panel, a cover coupled to the chassis, a substrate disposed between the chassis and the cover, and a multi-band antenna disposed on the substrate, wherein the multi-band antenna includes a first radiator configured to transmit and receive radio signals in a first frequency band and disposed on the substrate extending parallel to the substrate, and a second radiator configured to transmit and receive radio signals in a second frequency band different from the first frequency band and protruding toward the cover at a position adjacent to the first radiator.

The first frequency band may be higher than the second frequency band.

The first frequency band may be 5 GHz, and the second frequency band may be 2.4 GHz.

The substrate may be disposed inside from an edge of the chassis.

The substrate may include a conductive region in which a conductive layer providing ground to the first radiator and the second radiator is formed, and a fill cut region in which the conductive layer is not formed, and the first radiator and the second radiator may be disposed on the fill cut region.

The second radiator may be surface mounted on the substrate.

The second radiator may include at least one vertical radiation plate disposed perpendicular to the substrate.

The second radiator may include a first vertical radiation plate, a second vertical radiation plate, and a third vertical radiation plate, the first vertical radiation plate and the third vertical radiation plate may face each other, and the second vertical radiation plate may be orthogonal to the first vertical radiation plate and the third vertical radiation plate between the first vertical radiation plate and the third vertical radiation plate.

The second radiator may be formed by cutting and bending a single metal plate.

The multi-band antenna may include a plurality of Wi-Fi antennas each including the first radiator and the second radiator; and the plurality of Wi-Fi antennas may be symmetrically disposed on opposite sides of the substrate, respectively.

The display apparatus may further include a Bluetooth antenna disposed between the plurality of Wi-Fi antennas.

The display apparatus may further include a communication module comprising communication circuitry mounted on the substrate and configured to process radio signals transmitted and received through the multi-band antenna.

The display apparatus may further include a main board on which electronic components configured to process an image signal for displaying an image on the display panel are mounted, wherein the substrate may be coupled to the main board through a spacer.

In accordance with another example embodiment of the disclosure, a display apparatus includes: a display panel, a chassis supporting the display panel, a main board coupled to a rear surface of the chassis and configured to process a signal for displaying an image on the display panel, a communication board disposed at the rear of the main board parallel to the main board, and a multi-band antenna disposed on the substrate, wherein the multi-band antenna includes a first radiator configured to transmit and receive radio signals in a first frequency band, and a second radiator configured to transmit and receive radio signals in a second frequency band different from the first frequency band and including at least one radiation plate disposed within a specified distance of the first radiator and to be perpendicular to the first radiator.

The first frequency band may be higher than the second frequency band.

The first frequency band may be 5 GHz, and the second frequency band may be 2.4 GHz.

The communication board may be disposed inside an edge of the chassis.

The display apparatus may further include a spacer between the main board and the communication board, the spacer coupling the main board and the communication board in a state of being spaced apart from each other.

The chassis may comprise a metal material.

The display apparatus may further include a cover coupled to the rear of the chassis to cover the main board, the communication board, and the multi-band antenna.

BRIEF DESCRIPTION OF THE DRAWINGS

These and other aspects, features and advantages of certain embodiments of the present disclosure will be more apparent from the following detailed description, taken in conjunction with the accompanying drawings, in which.

DETAILED DESCRIPTION

The various example embodiments and the drawings described and illustrated in the present disclosure are merely example embodiments of the present disclosure, and thus it is to be understood that various modifications, of the embodiments and the drawings described in the present disclosure, are possible.

The singular expressions herein may include plural expressions, unless the context clearly dictates otherwise. In order to clearly illustrate the disclosure, parts not related to the description may be omitted from the drawings, and the size of the components may be slightly exaggerated to facilitate understanding.

The terms "comprises" and "has" are intended to indicate that there are features, numbers, steps, operations, elements, parts, or combinations thereof described in the disclosure, and do not exclude the presence or addition of one or more other features, numbers, steps, operations, elements, parts, or combinations thereof.

The terms "forward," "rearward," "upper side," "lower side," "left side," "right side," etc. used in the following description may be defined based on the directions indicated in FIG. 1. X-axis, Y-axis, and Z-axis directions perpendicular to each other are indicated in FIG. 1, +X-axis and −X-axis directions refer to the right and left directions of the display apparatus, +Y-axis and −Y-axis directions refer to the upward and downward directions of the display apparatus, and +Z-axis and −Z-axis directions refer to the forward and rearward directions of the display apparatus.

Hereinafter, various example embodiments of the disclosure will be described in greater detail with reference to the accompanying drawings.

Figure 1:
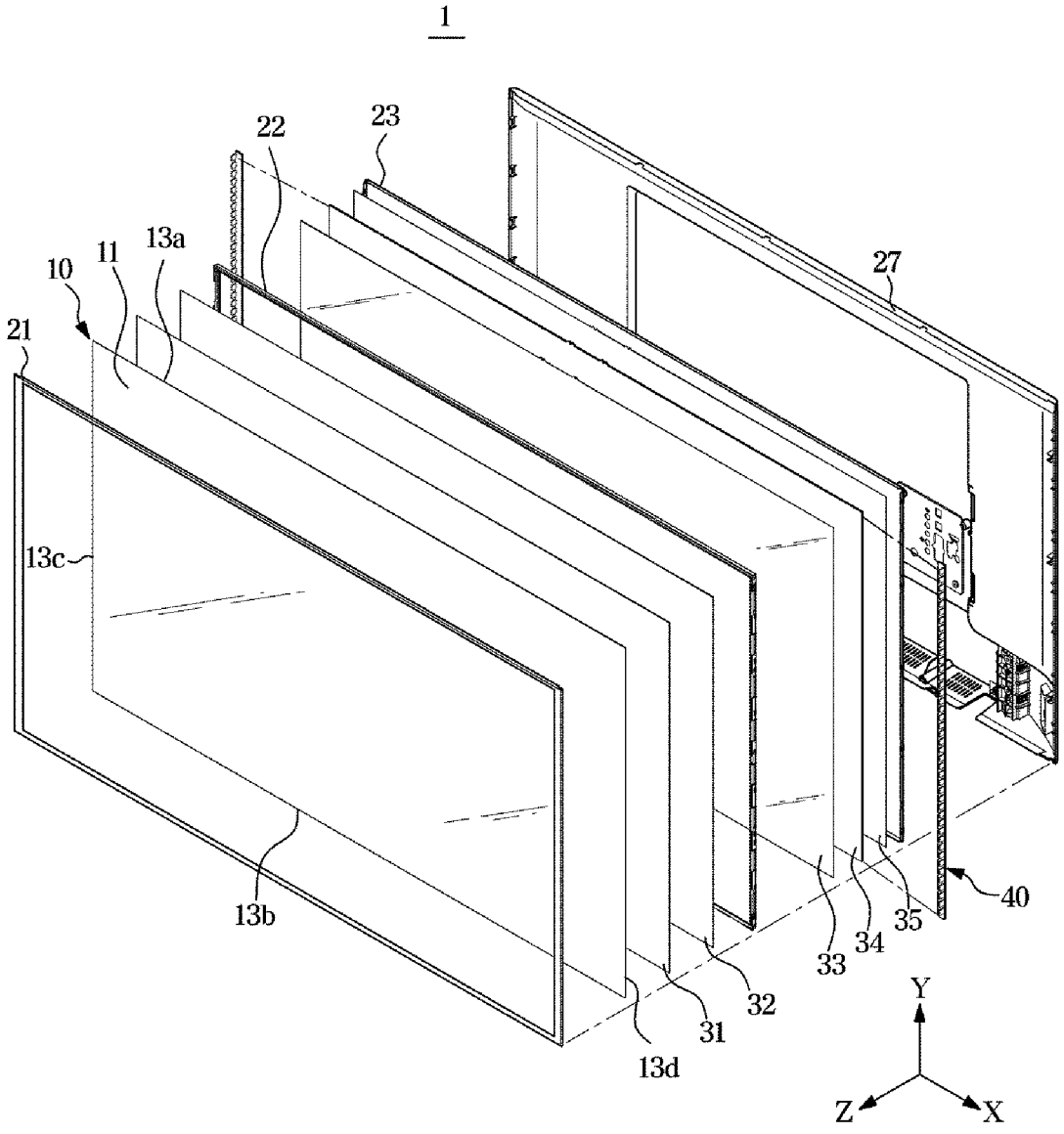
FIG. 1 is an exploded perspective view illustrating an example display apparatus according to various embodiments.

FIG. 1 is an exploded perspective view illustrating an example display apparatus according to various embodiments.

Referring to FIG. 1, the display apparatus 1 may include a television that processes broadcast images based on broadcast signals, broadcast information and broadcast data received from transmission equipment of a broadcaster. However, the display apparatus 1 is not limited to television, and may include various devices that display information, materials, data, etc. as characters, figures, graphs, images, etc., for example, a computer monitor, a mobile phone, an electronic board, a signage, and the like.

The display apparatus 1 may receive image signals from various types of external devices, such as a smart phone, a tablet, and a computer. Also, the display apparatus 1 may display videos, photos, applications, on-screen display (OSD), and a user interface for control based on signals and data stored in internal or external storage media, on a screen.

The display apparatus 1 may be implemented as a smart TV or an internet protocol TV (IP TV). The smart TV may receive and display broadcast signals in real time, and has a web browsing function so that a variety of contents may be searched and purchased through the Internet at the same time as displaying a real-time broadcast signal.

The display apparatus 1 may include a display panel configured to display an image. In an embodiment, the display panel may be implemented as a liquid crystal panel 10. However, the disclosure is not limited thereto, and the display panel may be a self-emitting type organic light emitting diode (OLED) panel or a micro LED panel. In this case, a backlight unit, which will be described later, may be omitted.

The liquid crystal panel 10 may include a thin film transistor substrate in which thin film transistors are formed in a matrix form, a color filter substrate coupled in parallel with the thin film transistor substrate, and a liquid crystal injected between the thin film transistor substrate and the color filter substrate and having optical properties variable in response to a change in voltage or temperature.

The liquid crystal panel 10 may have a front side 11 on which an image is displayed, a rear side formed on the opposite side of the front side 11, and four of upper, lower, left, and right sides 13*a*, 13*b*, 13*c*, and 13*d*.

The display apparatus 1 may include a backlight unit disposed behind the liquid crystal panel 10 to provide light to the liquid crystal panel 10, and a chassis assembly configured to support the backlight unit and the liquid crystal panel 10.

The backlight unit may be disposed behind the liquid crystal panel 10 to radiate light toward the liquid crystal panel 10. The backlight unit may include a light source module 40 including a light source and a substrate on which the light source is mounted, and optical members disposed on a moving path of light emitted from the light source.

The light source module 40 may be disposed to correspond to at least one side surface of the liquid crystal panel 10. For example, the light source module 40 may be disposed to correspond to the left side 13*c* and the right side 13*d* of the liquid crystal panel 10. However, the number and location of the light source modules 40 are not limited thereto. For example, the light source module 40 may be disposed to correspond to the upper side 13*a* and the lower side 13*b* of the liquid crystal panel 10, may be disposed to correspond to four of the upper, lower, left, and right sides 13*a*, 13*b*, 13*c*, and 13*d*, or may be disposed to correspond to only one of four of the upper, lower, left, and right sides 13*a*, 13*b*, 13*c*, and 13*d*. The light source module 40 may be disposed at the rear of the liquid crystal panel 10 rather than at the side of the liquid crystal panel 10.

A blue light emitting diode (LED) may be used as a light source. In addition, a cold cathode fluorescent lamp (CCFL) or an external electrode fluorescent lamp (EEFL) may be used as a light source.

The optical members may be disposed on a moving path of light emitted from the light source module 40 to guide a traveling direction of light or improve optical properties. The optical members may include a light guide plate 34 configured to guide light emitted from the light source to the liquid crystal panel 10 side, a reflective sheet 35 configured to reflect light emitted from the light source module 40 or light emitted rearward from the light guide plate 34, optical sheets 31 and 32 configured to improve optical properties such as luminance improvement, and a quantum dot sheet 33 configured to improve color reproducibility.

The optical sheets 31 and 32 may be disposed in front of the light guide plate 34 to improve optical characteristics of light emitted from the light guide plate 34. The optical sheets 31 and 32 may include a prism sheet configured to improve luminance by concentrating light, a protection sheet configured to protect other optical sheets from external impact or foreign matter inflow, a reflective polarizing sheet (DBEF; Dual Brightness Enhancement Film) configured to improve luminance by transmitting one polarized light and reflecting the other polarized light, and the like.

The quantum dot sheet 33 may improve color reproducibility by changing a wavelength of light. Quantum dots, which are semiconductor crystals emitting light having a size of several nanometers, may be distributed and disposed inside the quantum dot sheet 33. Quantum dots may receive blue light and generate light of various wavelengths, that is, all colors of visible light, depending on a size thereof.

The chassis assembly may include a rear chassis 23 configured to support the backlight unit, a front chassis 21 disposed in front of the rear chassis 23 to support the liquid crystal panel 10, and a middle mold 22 coupled between the front chassis 21 and the rear chassis 23.

The rear chassis 23 may be disposed behind the backlight unit. The rear chassis 23 may substantially have a plate shape in which an edge portion thereof is bent forward. The backlight unit may be accommodated between the rear chassis 23 and the front chassis 21.

The rear chassis 23 may function to dissipate heat generated from a heating element such as a light source to the outside. To this end, the rear chassis 23 may be formed of various metal materials such as aluminum and SUS, or plastic materials such as ABS.

The front chassis 21 may have a frame shape having an opening through which the front side 11 of the liquid crystal panel 10 is exposed. The middle mold 22 may be coupled between the front chassis 21 and the rear chassis 23 to support the liquid crystal panel 10, the light guide plate 34 and the optical sheets 31 and 32.

Various electronic components configured to drive the display apparatus 1 and process image signals for displaying images on a display panel, a substrate on which the electronic components are mounted, and a communication device for communication with external devices may be provided on a rear surface 24 (see FIG. 2) of the rear chassis 23.

A cover 27 configured to cover the various electronic components and to form an outer rear appearance of the display apparatus 1 may be coupled to the rear of the rear chassis 23.

Figure 2:
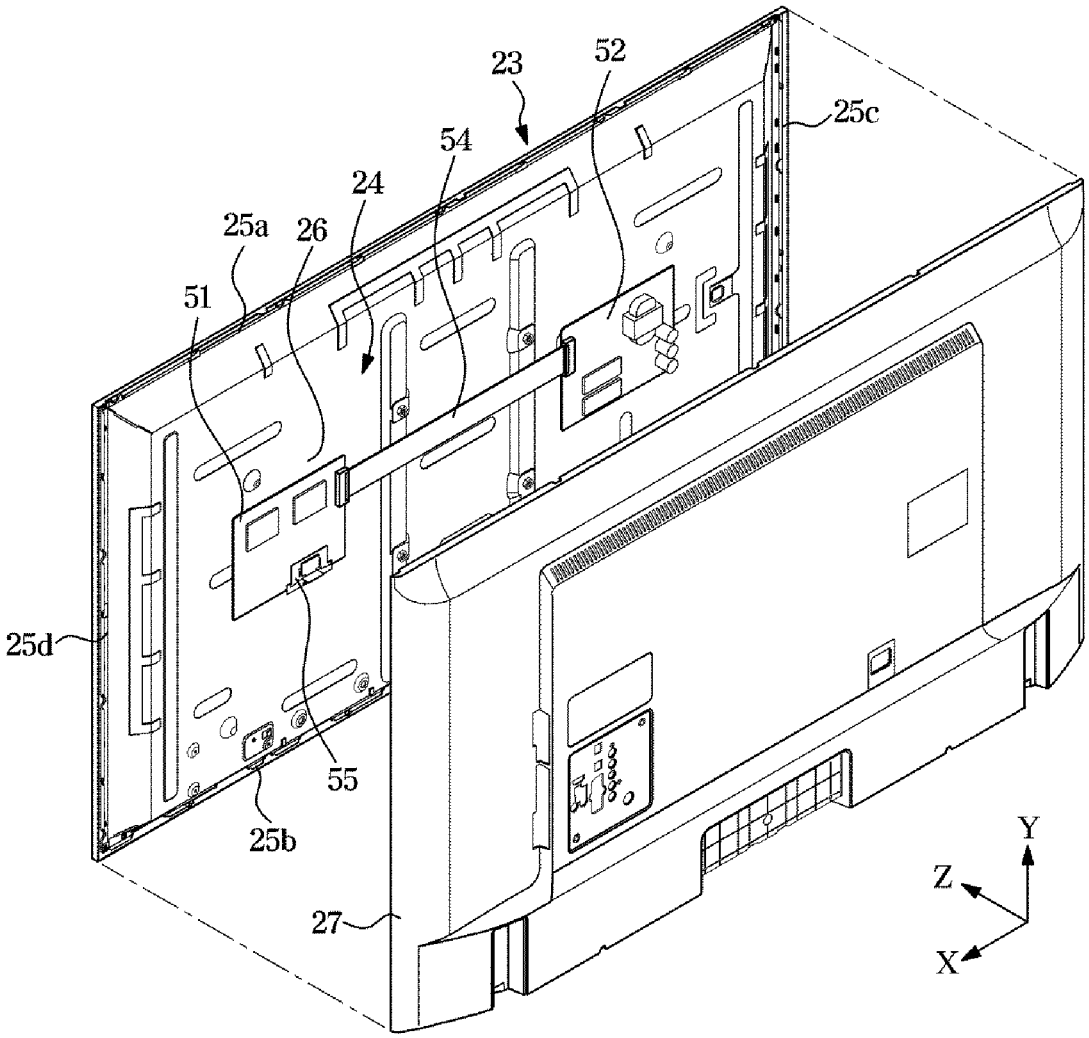
FIG. 2 is a rear perspective view illustrating an example cover separated from the display apparatus of FIG. 1 according to various embodiments.
Figure 3:
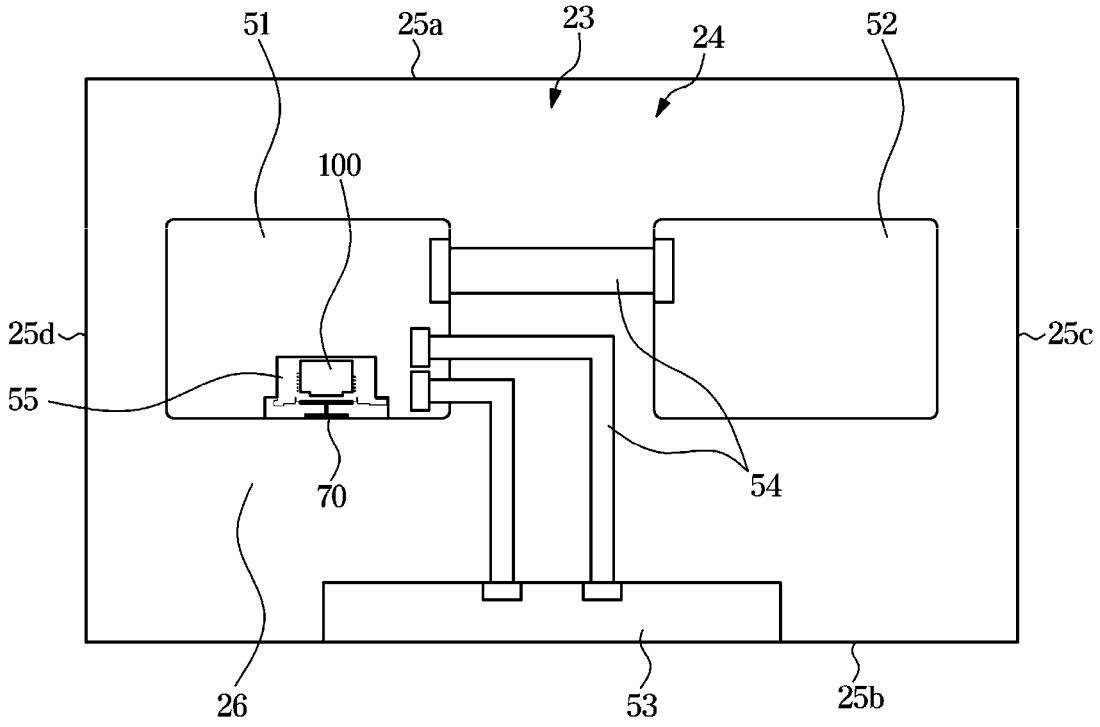
FIG. 3 is a diagram illustrating a rear surface of a chassis of the display apparatus of FIG. 1 according to various embodiments.

FIG. 2 is a rear perspective view illustrating a cover separated from the display apparatus of FIG. 1 according to various embodiments, and FIG. 3 is a diagram illustrating an example rear surface of a chassis of the display apparatus of FIG. 1 according to various embodiments.

Referring to FIGS. 2 and 3, a main board 51 on which at least one electronic component is mounted to perform a process for displaying an image signal, a power supply 52 for supplying power to the display apparatus 1, and a driver 53 for displaying an image corresponding to an image signal on the liquid crystal panel 10 may be provided on the rear surface 24 of the rear chassis 23.

The main board 51, the power supply 52, and the driver 53 may be connected to each other by a cable 54.

Electronic components mounted on the main board 51 may include a chipset, a memory, and the like, and the main board 51 may be provided with a wiring or a transmission line to electrically connect the electronic components. The electronic components provided on the main board 51 may include a tuner for tuning a broadcast signal for each channel and an image processor for processing an image signal. The image processor may be implemented as an individual configuration that may independently perform each process for processing an image signal, that is, as a group of electronic components, or may be implemented as a form included in a main SoC (System-on-chip) in which several functions are integrated. The main SoC may include at least one processor that controls the overall operation of the display apparatus 1 and signal flow between internal components.

The processor may include various processing circuitry and load a control program so as to perform a control operation and execute the loaded control program. The processor may include at least one of a central processing unit (CPU), a microprocessor, and an application processor (AP).

A signal generated or combined through the image processor may be output to the liquid crystal panel 10 through the driver 53. The driver 53 may be implemented as a control board provided with a timing controller that controls a driving circuit and improves image quality.

The power supply 52 may supply power to each component of the display apparatus 1. The power supply 52 converts and supplies commercial AC power input from the outside into power supplied to each component of the display apparatus 1 and may include an inverter or a switching mode power supply (SMPS).

The main board 51 may be disposed inside from an edge of the display apparatus 1. That is, the main board 51 may be disposed on an inner side 26 from edges 25*a*, 25*b*, 25*c*, and 25*d* of the rear chassis 23.

A multi-band antenna 70 configured to transmit and receive radio frequency (RF) signals for communication between the display apparatus 1 and an external device may be provided on a communication board 55. The multi-band antenna 70 may transmit and receive RF signals of, for example, 2.4 GHz and 5 GHz.

A communication module 100 may include various communication circuitry configured to process an RF signal may be provided on the communication board 55. The communication module 100 may be implemented as an electronic component in the form of a chipset mounted on the communication board 55. The communication module 100 may process an RF signal under control of the processor so that the display apparatus 1 may communicate with an external device.

The communication module 100 may be implemented according to any one of various communication methods. As an example, the communication module 100 may be configured to perform data communication according to the Wi-Fi standard of the American Institute of Electrical and Electronic Engineers (IEEE).

Figure 6:
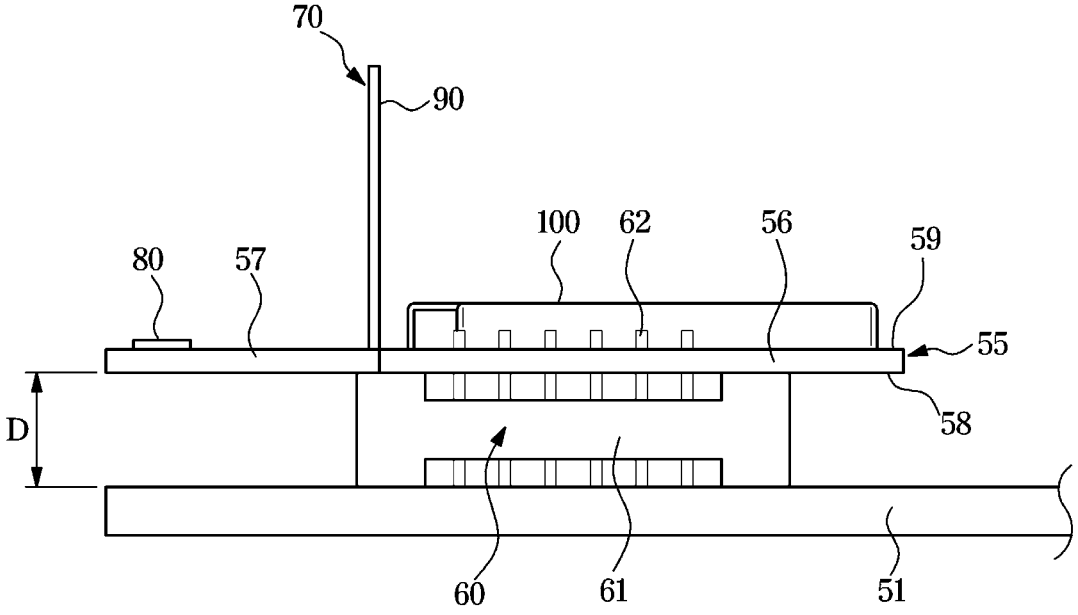
FIG. 6 is a side view of the communication board and the multi-band antenna of the display apparatus of FIG. 1 according to various embodiments.

The communication board 55 may be disposed at the rear of the main board 51 to be spaced apart from the main board 51 by a predetermined distance D (see FIG. 6). Accordingly, the communication board 55 may also be disposed on the inner side 26 from the edges 25*a*, 25*b*, 25*c*, and 25*d* of the rear chassis 23.

Figure 4:
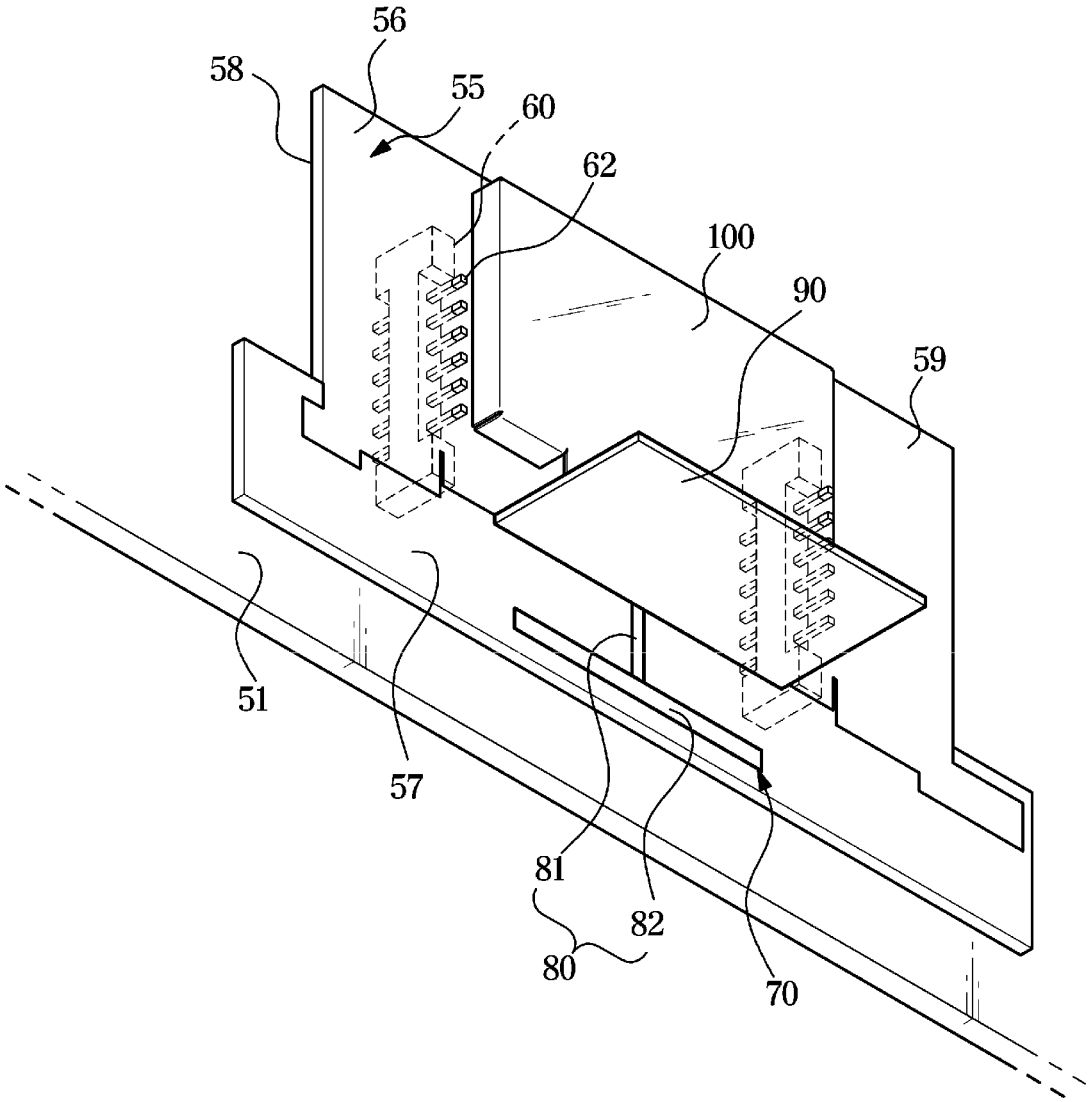
FIG. 4 is a perspective view illustrating an example communication board and a multi-band antenna of the display apparatus of FIG. 1 according to various embodiments.
Figure 5:
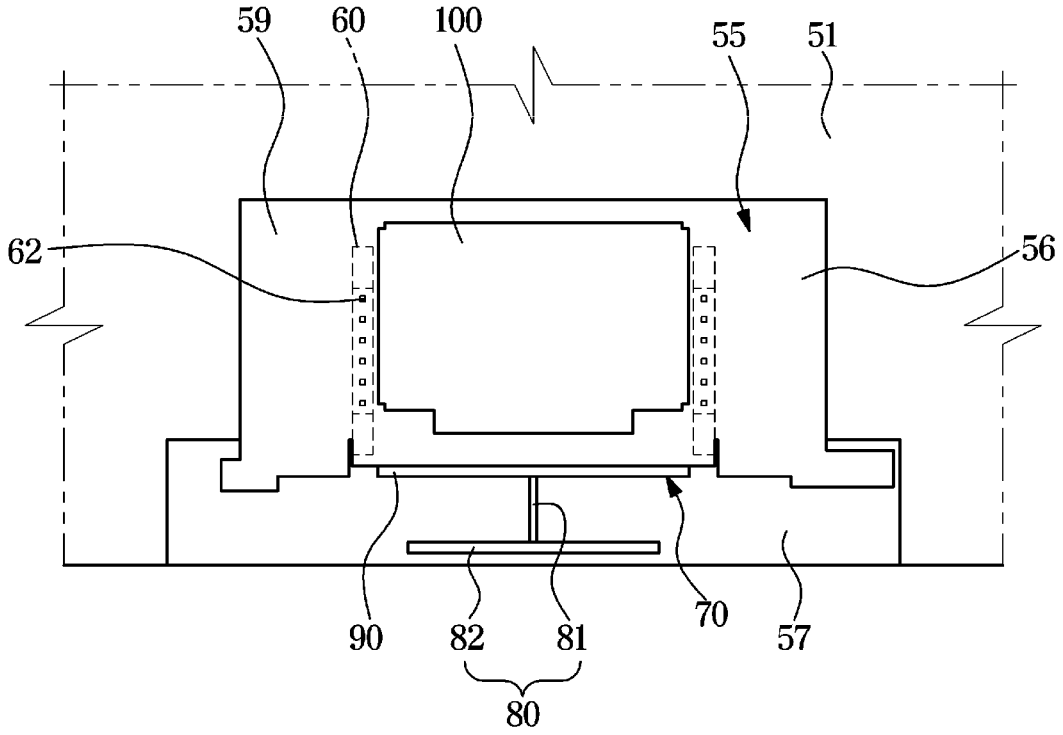
FIG. 5 is a rear view of the communication board and the multi-band antenna of the display apparatus of FIG. 1 according to various embodiments.

FIG. 4 is a perspective illustrating an example communication board and a multi-band antenna of the display apparatus of FIG. 1 according to various embodiments, FIG. 5 is a rear view of the communication board and the multi-band antenna of the display apparatus of FIG. 1 according to various embodiments, and FIG. 6 is a side view of the communication board and the multi-band antenna of the display apparatus of FIG. 1 according to various embodiments.

The display apparatus 1 may further include a spacer 60 disposed between the main board 51 and the communication board 55 to couple the main board 51 and the communication board 55 to be spaced apart from each other by a predetermined distance. The distance D between the main board 51 and the communication board 55 may be appropriately determined as an experimental value for securing the radiation performance.

A pair of the spacers 60 may be provided to be coupled to opposite edges of the communication board 55. The spacer 60 may include a housing 61 made of an insulator and supporting the main board 51 and the communication board 55, and a plurality of signal transmission pins 62 for signal transmission between the main board 51 and the communication board 55. The plurality of signal transmission pins 62 may protrude toward the main board 51 and the communication board 55 to be coupled to the main board 51 and the communication board 55. A plurality of through holes into which the plurality of signal transmission pins 62 is inserted and coupled is formed on the main board 51 and the communication board 55, respectively, and the plurality of through holes may be through holes having a plated inner surface.

As such, as the main board 51 and the communication board 55 are electrically connected by the plurality of signal transmission pins 62 of the spacer 60, the communication module 100 provided on the communication board 55 may be controlled by the processor provided on the main board 51.

The communication board 55 may be provided with the multi-band antenna 70 capable of transmitting and receiving wireless signals in a plurality of frequency bands.

The multi-band antenna 70 may include a first radiator 80 configured to transmit and receive radio signals in a first frequency band, and a second radiator 90 configured to transmit and receive radio signals in a second frequency band.

The first frequency band may be higher than the second frequency band. The first frequency band may be 5 GHz, and the second frequency band may be 2.4 GHz.

The first radiator 80 and the second radiator 90 may be formed of an electrically conductive member, e.g., a metal. The first radiator 80 and the second radiator 90 may be connected to a printed circuit pattern formed on the communication board 55.

The communication board 55 may have a conductive region 56 in which a conductive layer is formed and a fill cut region 57 in which a conductive layer is not formed, and the first radiator 80 and the second radiator 90 may be provided on the fill cut region 57. Metal materials such as gold, silver, copper, nickel, and aluminum may be used for the conductive layer. Because the first radiator 80 and the second radiator 90 are provided on the fill cut region 57, a decrease in radiation gain efficiency due to the surrounding metal body may be prevented and/or reduced. The conductive region 56 may provide ground to the first radiator 80 and the second radiator 90.

The first radiator 80 may be formed on the communication board 55 to extend parallel to the communication board 55. The communication board 55 may include a first surface 58 facing the main board 51 and a second surface 59 formed on the opposite side of the first surface 58 and facing the cover 27.

The first radiator 80 may be formed on the second surface 59. The first radiator 80 may include a first portion 81 extending downward and a second portion 82 extending left and right from an end of the first portion 81. Lengths and widths of the first portion 81 and the second portion 82 may be appropriately determined depending on the band characteristics.

The second radiator 90 may be formed to protrude toward the cover 27 from a position adjacent to the first radiator 80.

The second radiator 90 may have a rectangular plate shape. The second radiator 90 may be disposed perpendicular to the communication board 55. The second radiator 90 may be arranged such that a normal orthogonal to the second radiator 90 is parallel to the first portion 81 of the first radiator 80. A length or an area of the second radiator 90 may be appropriately determined depending on the band characteristics.

The second radiator 90 may be surface mounted on the second surface 59 of the communication board 55. For example, the second radiator 90 may be a surface mount device (SMD).

With this structure, the second radiator 90 may perform a function of a reflector for reflecting radio waves radiated from the first radiator 80 as well as a function of transmitting and receiving a radio signal in the second frequency band. The radio waves radiated from the first radiator 80 may be refracted, reflected, and diffracted through the second radiator 90 to be radiated downward, laterally, and forward of the display apparatus 1.

Figure 7:
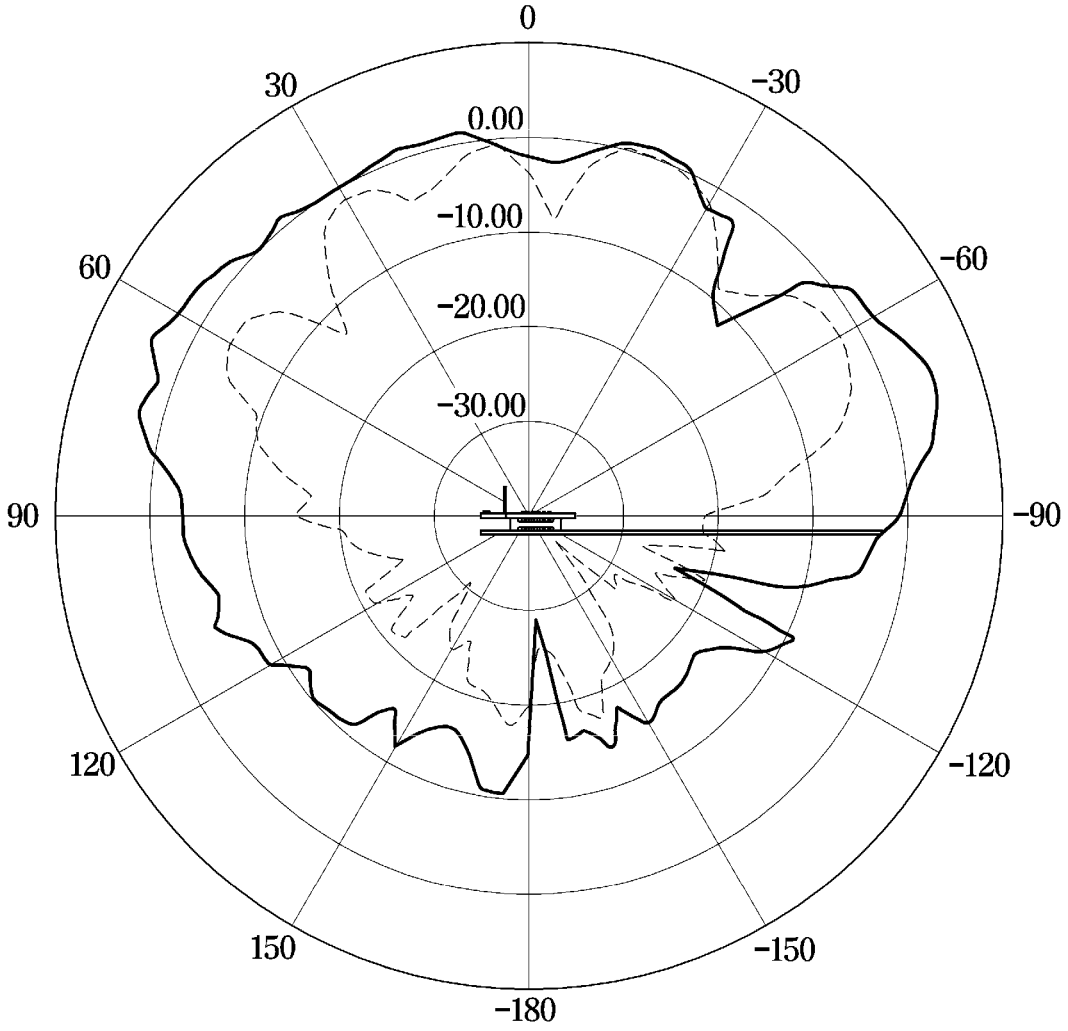
FIG. 7 is a diagram illustrating improved radiation performance of the multi-band antenna in the display apparatus according to various embodiments.

FIG. 7 is a diagram illustrating improved radiation performance of the multi-band antenna in the display apparatus according to various embodiments.

In FIG. 7, the dotted line represents the radiation performance of the first radiator 80 when the second radiator 90 is omitted and only the first radiator 80 is provided in the above-described embodiment, and the solid line represents the radiation performance of the first radiator 80 when the second radiator 90 is not omitted in the above-described embodiment.

As shown in FIG. 7, it may be seen that as the second radiator 90 is vertically erected near the first radiator 80 so that the second radiator 90 serves as a reflector, the radiation performance in side, rear, and front surfaces of the first radiator 80 is generally improved.

Figure 8:
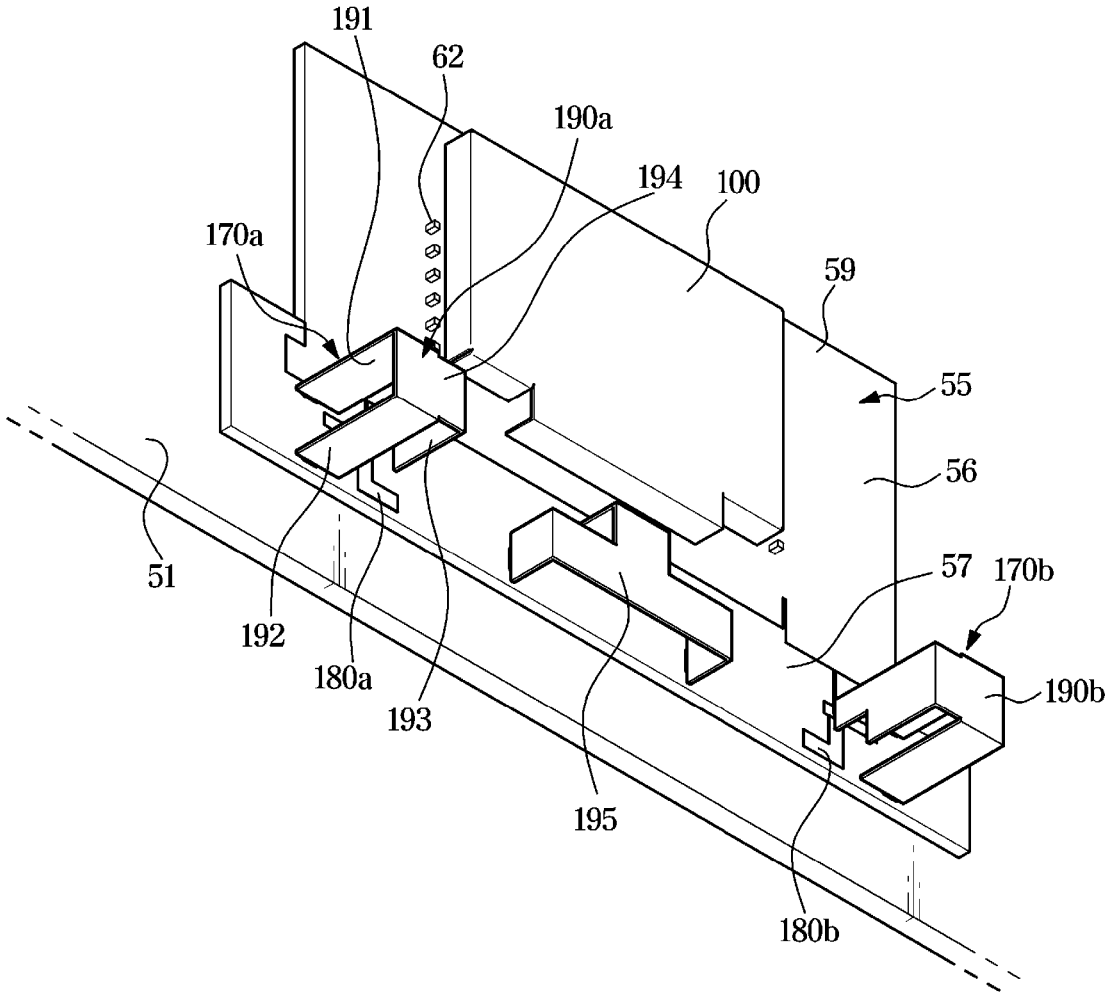
FIG. 8 is a perspective view illustrating an example multi-band antenna according to various embodiments.

FIG. 8 is a diagram illustrating an example multi-band antenna according to various embodiments.

Hereinafter, a multi-band antenna according to an embodiment of the disclosure will be described with reference to FIG. 8. The same reference numerals are assigned to the same components as in the above-described embodiment, and a description thereof may not be repeated here.

A multi-band antenna may include a plurality of Wi-Fi antennas 170*a* and 170*b* each including first radiators 180*a* and 180*b* and second radiators 190*a* and 190*b*. One of the plurality of Wi-Fi antennas 170*a* and 170*b* may be used for transmission, and the other may be used for reception. The plurality of Wi-Fi antennas 170*a* and 170*b* may be symmetrically disposed on both left and right sides of the communication board 55.

As in the above-described embodiment, the second radiators 190*a* and 190*b* may be formed to protrude toward the cover 27 at positions adjacent to the first radiators 180*a* and 180*b*.

The second radiators 190*a* and 190*b* may have a three-dimensional shape. As an example, the second radiator 190*a* may include one or more vertical radiation plates 191, 192, and 193 disposed perpendicular to the communication board 55. The one or more vertical radiation plates 191, 192, and 193 may include the first vertical radiation plate 191, the second vertical radiation plate 193, and the third vertical radiation plate 192.

The first vertical radiation plate 191 and the third vertical radiation plate 192 may be formed to face each other, and the second vertical radiation plate 193 may be formed orthogonal to the first vertical radiation plate 191 and the third vertical radiation plate 192 between the first vertical radiation plate 191 and the third vertical radiation plate 192. The second radiator 190*a* may further include a horizontal radiation plate 194 formed horizontally at ends of the first vertical radiation plate 191, the second vertical radiation plate 193, and the third vertical radiation plate 192.

The second radiators 190*a* and 190*b* may be formed by cutting and bending a single metal plate.

As such, because the second radiators 190*a* and 190*b* may include the one or more vertical radiation plates 191, 192 and 193 and the horizontal radiation plate 194, the effect of functioning as a reflector may be further increased.

A Bluetooth antenna 195 may be provided between the plurality of Wi-Fi antennas 170*a* and 170*b*.

As is apparent from the above, according to various embodiments of the disclosure, radiation performance of a multi-band antenna provided in a display apparatus can be improved.

For example, even when the multi-band antenna is located inside from an edge of the display apparatus, the forward radiation performance can be ensured.

While the disclosure has been illustrated and described with reference to various example embodiments, it should be understood that the various example embodiments are intended to be illustrative, not limiting. It will be further understood by those skilled in the art that various changes in form and detail may be made without departing from the true spirit and full scope of the disclosure, including the appended claims and their equivalents.

What is claimed is:

1. A display apparatus comprising:

a display panel;

a chassis supporting the display panel;

a cover coupled to the chassis;

a substrate disposed between the chassis and the cover; and a multi-band antenna disposed on the substrate, wherein the multi-band antenna comprises:

a first radiator configured to transmit and receive radio signals in a first frequency band, disposed on the substrate and extending parallel to the substrate; and a second radiator configured to transmit and receive radio signals in a second frequency band different from the first frequency band, configured to refract, reflect and diffract radio waves in the first frequency band radiated from the first radiator, and protruding toward the cover adjacent to the first radiator.

2. The display apparatus according to claim 1, wherein the first frequency band is higher than the second frequency band.

3. The display apparatus according to claim 1, wherein the first frequency band is 5 GHz, and the second frequency band is 2.4 GHz.

4. The display apparatus according to claim 1, wherein the substrate is disposed spaced from and inside an edge of the chassis.

5. The display apparatus according to claim 1, wherein:

the substrate comprises a conductive region including a conductive layer configured to provide a ground to the first radiator and the second radiator, and a fill cut region in which the conductive layer is not formed; and the first radiator and the second radiator are disposed on the fill cut region.

6. The display apparatus according to claim 1, wherein the second radiator is surface mounted on the substrate.

7. The display apparatus according to claim 1, wherein the second radiator comprises at least one vertical radiation plate disposed perpendicular to the substrate.

8. The display apparatus according to claim 7, wherein:

the second radiator comprises a first vertical radiation plate, a second vertical radiation plate, and a third vertical radiation plate;

the first vertical radiation plate and the third vertical radiation plate face each other; and the second vertical radiation plate is orthogonal to the first vertical radiation plate and the third vertical radiation plate and disposed between the first vertical radiation plate and the third vertical radiation plate.

9. The display apparatus according to claim 8, wherein the second radiator is formed by cutting and bending a single metal plate.

10. The display apparatus according to claim 1, wherein:

the multi-band antenna comprises a plurality of Wi-Fi antennas each comprising the first radiator and the second radiator; and the plurality of Wi-Fi antennas is symmetrically disposed on opposite sides of the substrate, respectively.

11. The display apparatus according to claim 10, further comprising a Bluetooth antenna disposed between the plurality of Wi-Fi antennas.

12. The display apparatus according to claim 1, further comprising a communication module mounted on the substrate, the communication module comprising communication circuitry configured to process radio signals transmitted and received through the multi-band antenna.

13. The display apparatus according to claim 1, further comprising a main board on which electronic components including circuitry configured to process an image signal for displaying an image on the display panel are mounted, wherein the substrate is coupled to the main board through a spacer.

14. A display apparatus comprising:

a display panel;

a chassis supporting the display panel;

a main board coupled to a rear surface of the chassis and configured to process a signal for displaying an image on the display panel;

a communication board disposed at the rear of the main board parallel to the main board; and a multi-band antenna disposed on the communication board, wherein the multi-band antenna comprises:

a first radiator configured to transmit and receive radio signals in a first frequency band; and a second radiator configured to transmit and receive radio signals in a second frequency band different from the first frequency band, the second radiator comprising at least one radiation plate disposed within a specified distance of the first radiator and perpendicular to the first radiator, and the second radiator configured to refract, reflect and diffract radio waves in the first frequency band radiated from the first radiator.

15. The display apparatus according to claim 14, wherein the first frequency band is higher than the second frequency band.

16. The display apparatus according to claim 14, wherein the first frequency band is 5 GHz, and the second frequency band is 2.4 GHz.

17. The display apparatus according to claim 14, wherein the communication board is disposed spaced from and inside edge of the chassis.

18. The display apparatus according to claim 14, further comprising a spacer disposed between the main board and the communication board coupling the main board and the communication board in a state of being spaced apart from each other.

19. The display apparatus according to claim 14, wherein the chassis comprises a metal material.

20. The display apparatus according to claim 14, further comprising a cover coupled to the rear of the chassis covering the main board, the communication board, and the multi-band antenna.

* * * * *